United States Patent [19]

Milligan

[11] 4,392,477

[45] Jul. 12, 1983

[54] SOLID FUEL BURNING STOVE

[76] Inventor: Orley J. Milligan, 2319 Crater Lake Ave., Medford, Oreg. 97501

[21] Appl. No.: 258,633

[22] Filed: Apr. 29, 1981

[51] Int. Cl.[3] ..... F24C 1/14

[52] U.S. Cl. ..... 126/77; 126/163 R; 126/193

[58] Field of Search ..... 126/77, 193, 112, 146, 126/15 R, 15 A, 163 R, 163 A

[56] References Cited

U.S. PATENT DOCUMENTS

| | | | |
|---|---|---|---|
| 3,982,522 | 9/1976 | Hottenroth et al. | 126/146 |
| 4,140,101 | 2/1979 | Glover | 126/77 |
| 4,141,336 | 2/1979 | Fitch | 126/121 |
| 4,184,473 | 1/1980 | McIntire et al. | 126/77 |
| 4,200,086 | 4/1980 | Kolb | 126/77 |
| 4,201,185 | 5/1980 | Black | 126/15 R |
| 4,313,418 | 2/1982 | Schrader | 126/193 |
| 4,316,446 | 2/1982 | Russo | 126/193 |
| 4,349,009 | 9/1982 | Patterson et al. | 126/121 |
| 4,350,139 | 9/1982 | Robichaud | 126/163 R |
| 4,359,040 | 11/1982 | Martenson | 126/77 |

*Primary Examiner*—Daniel J. O'Connor
*Attorney, Agent, or Firm*—Harvey B. Jacobson

[57] ABSTRACT

A freestanding stove is provided including an elevated firebox mounted atop a tubular pedestal having a horizontally enlarged downwardly opening hollow base at its lower end. The firebox includes a combustion air inlet opening downwardly into the pedestal and the lower end of the pedestal opens downwardly into the hollow base which includes a damper for controlling the flow of combustion air from within the hollow base into the lower end of the pedestal. The base includes feet supporting the base a spaced distance above a horizontal surface upon which the feet rest and the feet are removable whereby the base may rest directly upon and over a horizontal support surface upwardly through which a combustion air opening is formed. The front of the firebox includes an openable transparent window equipped door and combustion air inlet passage structure for sweeping curtains of combustion air across the inner surface of the window from selected marginal portions thereof. The firebox further includes first, second and third stage combustion air inlets and the rear of the firebox includes a reversible smoke outlet fitting whereby the by-products of combustion may exhaust directly into either a horizontal or vertical outlet pipe. The door is reversibly mounted on the front of the firebox and rear upwardly extending exterior surfaces of the firebox include air blower structure operatively associated therewith for blowing ambient air across the firebox surfaces in intimate heat transfer relation therewith.

6 Claims, 10 Drawing Figures

SOLID FUEL BURNING STOVE

BACKGROUND OF THE INVENTION

Freestanding stoves are becoming increasingly popular with the result that many facturers of freestanding stoves are marketing stoves which are wholly operative and may well be in accordance with various state and county codes controlling the use of such stoves, but which are not operative in a superior manner to enable efficient and complete burning of solid fuel to be burned therein in order to produce the maximum amount of heat output for a given amount of fuel burned. Accordingly, a need exists for an efficient stove including features which not only enable efficient burning of fuel therein, but which also support dependable and convenient operation of the stove independent of many of the maintenance problems which are usually associated with freestanding stoves.

Examples of various forms of stoves and heaters including some of the general structural and operational features of the instant invention are disclosed in U.S. Pat. Nos. 152,566, 328,809, 1,135,478, 1,665,757, 2,875,748, 3,616,788, 3,981,292, 4,015,579, 4,099,511, 4,136,622, 4,140,101, 4,210,119, 4,230,091 and 4,233,955.

BRIEF DESCRIPTION OF THE INVENTION

The stove of the instant invention includes a hollow support pedestal upwardly through which combustion air for the firebox may pass and with the pedestal opening downwardly into a hollow downwardly opening horizontally enlarged base including low height foot portions for supporting the base in slightly spaced relation relative to a horizontal surface upon which the foot portions rest to thereby enable combustion air to enter the downwardly opening base beneath the marginal edges thereof. Alternately, the foot portions may be removed and the base may rest directly upon and overlie the horizontal surface upwardly through which a combustion air opening has been formed. The interior of the base includes damper structure operatively associated with the lower end of the tubular pedestal whereby the flow of combustion air upwardly through the pedestal may be controlled.

The firebox is mounted atop the pedestal and includes front, rear and opposite side walls with a fuel inlet opening provided in the front wall selectively closable by a reversibly mountable horizontally swingable door having a heat resistant transparent panel therein. The firebox includes a combustion air inlet manifold therewithin whereby combustion air being admitted into the firebox may be preheated immediately prior to being discharged into the firebox and the manifold is constructed in a manner to direct combustion air horizontally rearwardly in the firebox toward a fire therein from a point disposed in the forward portion of the firebox, to horizontally direct combustion air into the firebox from the opposite sides thereof, and to also direct combustion air into the forward portion of the firebox in an upward direction for mixing with and thus enabling more complete burning of unburned combustible gases formed in the upper portion of the firebox as a result of the combustion of solid fuel therein. The combustion air inlet manifold also includes portions thereof disposed about the periphery of the opening in the front wall of the firebox operative to cause combustion air to sweep across the inner surface of the transparent window of the door in order to maintain the window in a cooled state and to eliminate buildup of soot on the inner surface of the window.

Still further, the firebox includes an upper rear smoke outlet in front of which a full width baffle plate extends and the baffle plate curves upwardly and forwardly from a mid-height portion of the firebox and causes the heat and other byproducts of combustion of fuel within the firebox to roll forwardly in the upper portion of the firebox toward the forward marginal edge of the baffle plate and to thereafter roll upwardly and rearwardly about the forward edge of the baffle plate before moving rearwardly to the outlet. In addition, the baffle plate includes an upper flange which requires that the rearwardly moving heat and by-products of combustion split toward the opposite sides of the firebox and to then pass through opposite side openings formed in the flange before continuing rearwardly toward the centrally disposed smoke outlet.

Also, the interior or the firebox includes a depending smoke diverting flange which projects downwardly across the upper marginal portion of the opening formed in the front wall of the firebox and the flange is pivotally supported from the upper marginal edge of the front wall above the opening whereby the lower marginal portion of the flange may swing rearwardly and upwardly when introducing solid fuel to be burned into the firebox. Although the smoke flange projects downwardly from the upper marginal edge of the front wall opening only about 1/5 of the height of the opening, the smoke flange is disposed rearward of those portions of the combustion air inlet which admits combustion air inwardly of the firebox from the peripheral portions of the front wall extending about the transparent window carried by the door for the firebox. In this manner, the rolling action of smoke within the firebox toward the upper forward portion thereof which usually tends to cause soot to accumulate on the inner surface of a transparent window is substantially reduced.

The main object of this invention is to provide an improved heater including improved combustion air inlet structure and flame baffling structure to facilitate substantially complete burning of all of the combustible by-products of combustion of solid fuels within the firebox.

Another object of this invention is to provide a firebox design which will cause the flame and other heat products of combustion to travel a greater distance in intimate contact with exterior wall panels of the firebox during movement of the flames and other heat products of combustion from the main combustion area within the firebox to the smoke outlet therefor.

A further object of this invention is to provide an improved hinged door mounting and latching assembly for the opening equipped front wall of the firebox whereby the door may be oppositely mounted.

Yet another object of this invention is to provide three-stage combustion air inlet structure for the firebox to enhance complete combustion of fuel within the main fuel burning area of the firebox and to also facilitate complete burning of the gaseous by-products of combustion of fuel within the firebox.

Still another object of this invention is to provide a heater including a novel combustion air inlet passage defining pedestal therefor operative either in conjunction with an imperforate horizontal support surface upon which to rest the pedestal or a support surface having a combustion air inlet opening formed therethrough.

Still another important object of this invention is to provide a hinged smoke flange for the upper forward portion of the firebox to assist in preventing the accumulation of soot and tars on the inner surface of the transparent window of the door for the firebox.

A further object of this invention is to provide a smoke outlet fitting for the firebox which may be reversed in position in order to accommodate either a horizontal smoke outlet pipe or a vertical smoke outlet pipe.

Yet another object of this invention is to provide an external blower attachment for the heater operative to cause ambient air of appreciable quantities to flow across highly heated external wall panels of the firebox in intimate heat transfer relation therewith.

A final object of this invention to be specifically enumerated herein is to provide a heater in accordance with the preceding objects and which will conform to conventional forms of manufacture, be of simple construction and easy to use, so as to provide a device that will be economical feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is a fragmentary vertical sectional view taken substantially upon the plane indicated by the section line 6—6 of FIG. 2;

DESCRIPTION OF THE PREFERRED EMBODIMENT

Figure 1:
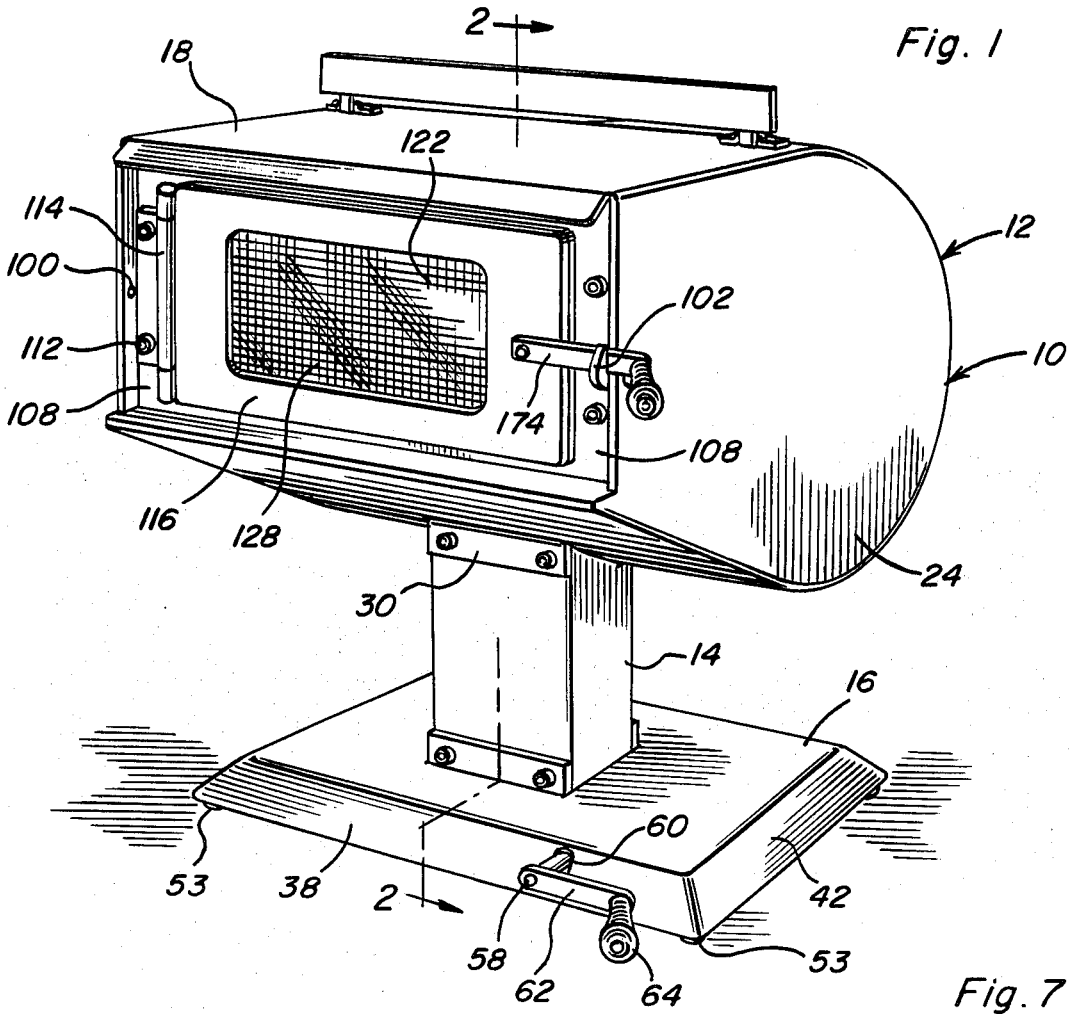
FIG. 1 is a perspective view of the freestanding heater of the instant invention.
Figure 5:
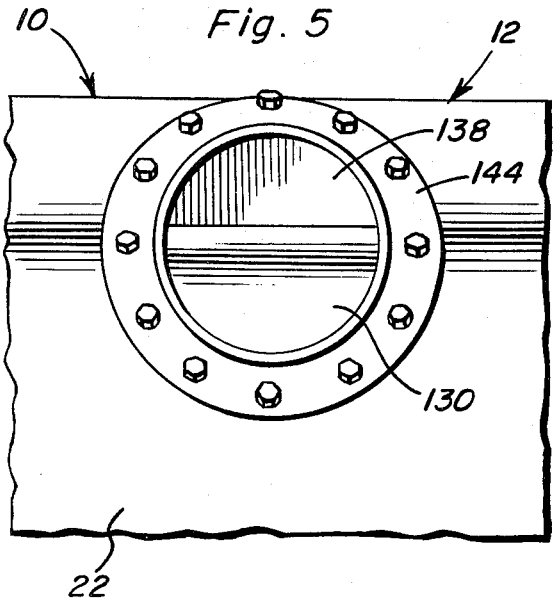
FIG. 5 is a vertical sectional view taken substantially upon the plane indicated by the section line 5—5 of FIG. 2.
Figure 7:
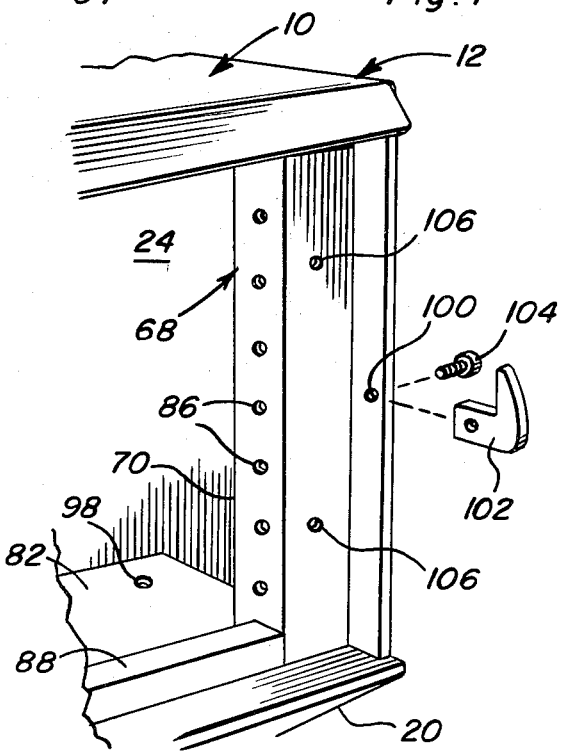
FIG. 7 is a fragmentary perspective view illustrating the manner in which the keeper for the latch may be removably mounted on either side wall of the heater.

Referring now more specifically to the drawings, the numeral 10 generally designates the heater of the instant invention. The heater 10 includes a firebox referred to in general by the reference numeral 12, a pedestal or standard 14 from atop which the firebox 12 is supported and a horizontally enlarged base 16 from which the lower end of the pedestal or standard 14 is supported.

Figure 2:
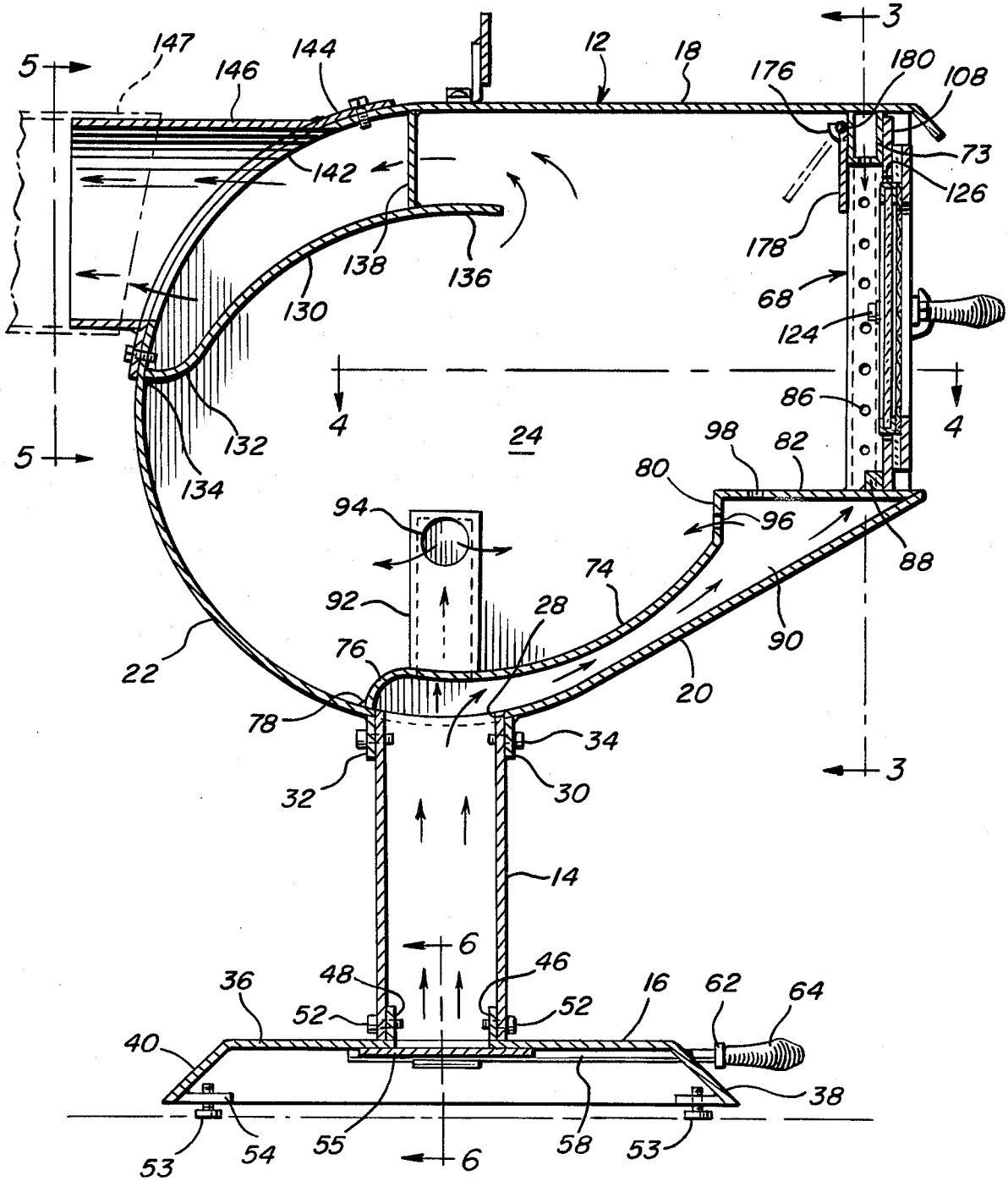
FIG. 2 is an enlarged vertical sectional view taken substantially upon the plane indicated by the section line 2—2 of FIG. 1.
Figure 3:
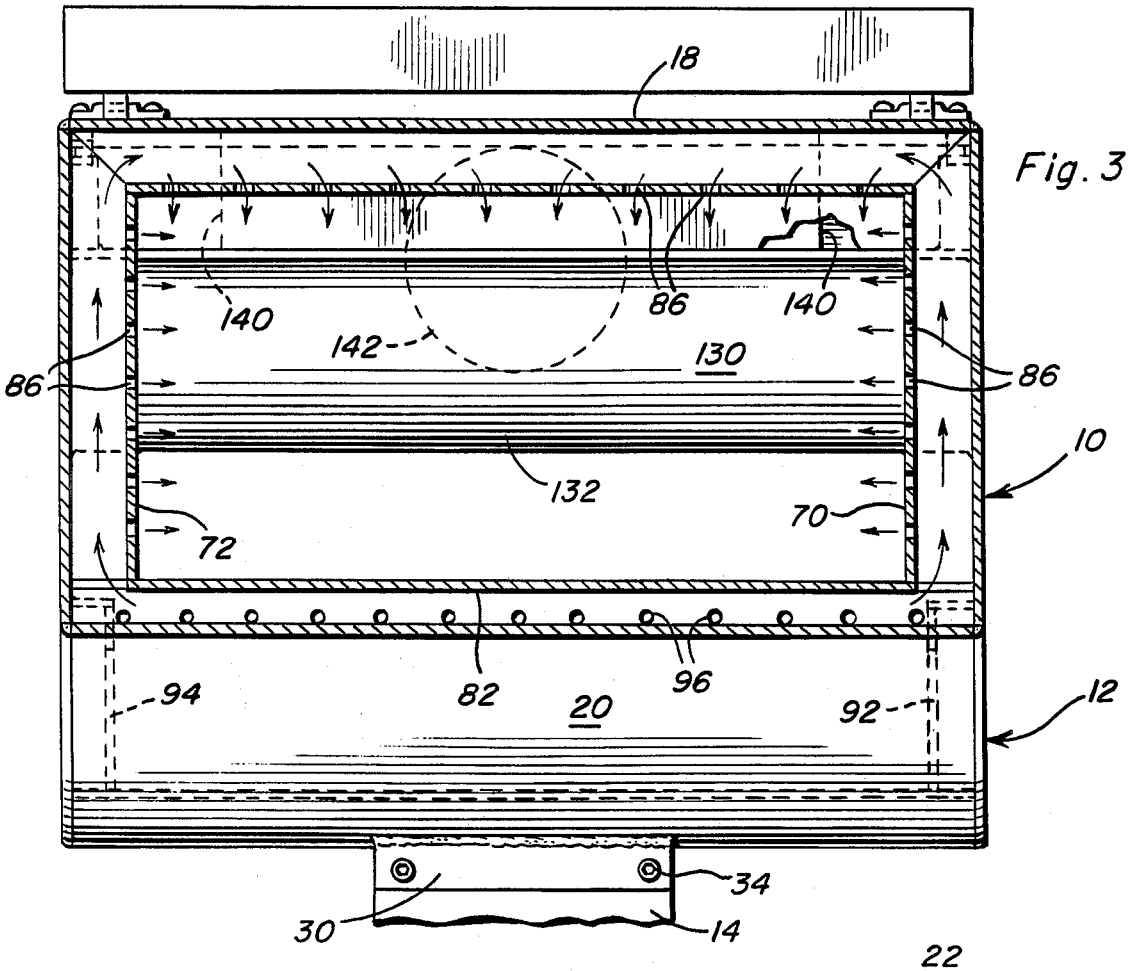
FIG. 3 is a vertical sectional view taken substantially upon the plane indicated by the section line 3—3 of FIG. 2.
Figure 4:
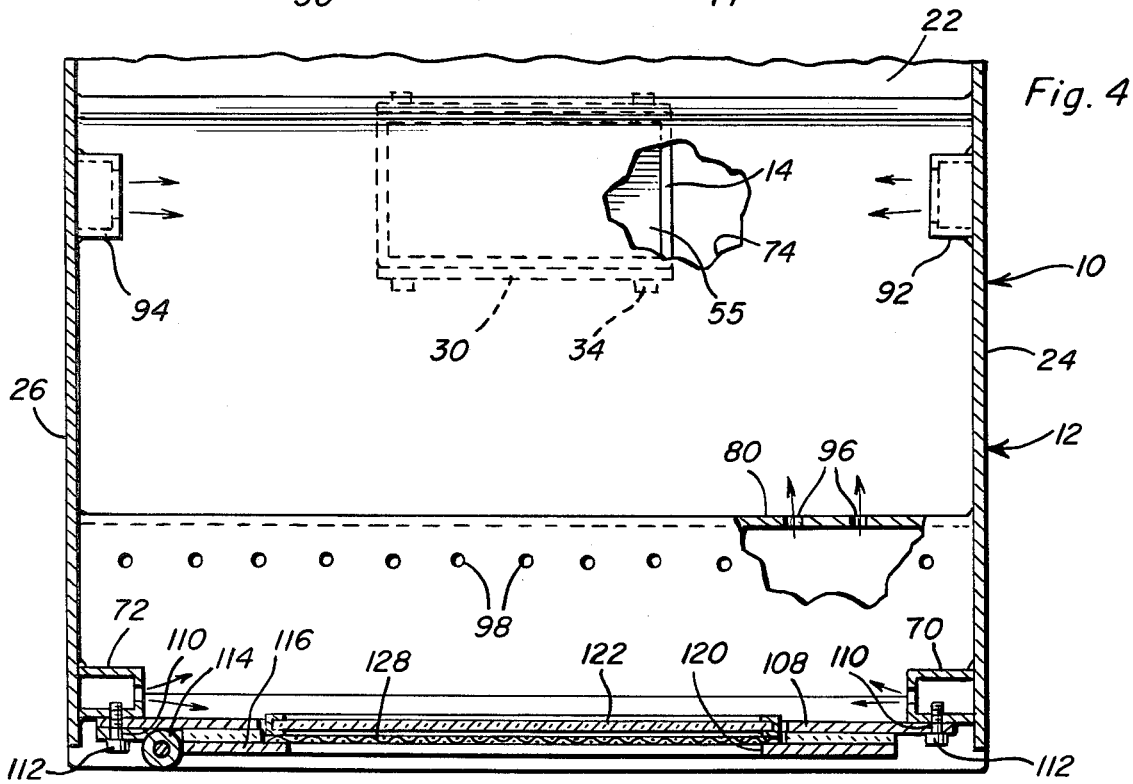
FIG. 4 is a fragmentary horizontal sectional view taken substantially upon the plane indicated by the section line 4—4 of FIG. 2.

As may best be seen from FIGS. 2 through 4 of the drawings, the firebox 12 includes a horizontal top wall 18, a rearwardly and downwardly inclined bottom wall 20, a forwardly opening semi-cylindrical rear wall 22 and a pair of upstanding substantially planar opposite side walls 24 and 26.

The lower marginal portion of the firebox in which the rear marginal edge of the bottom wall 20 and the lower marginal edge of the rear wall 22 merge together includes a combustion air inlet opening 28 formed therein and a pair of front and rear transverse depending mounting flanges 30 and 32 extend along and are secured to the marginal edges of the bottom wall 20 and rear wall 22 defining the forward and rearward extremities of the opening 28. The upper end of the tubular pedestal or standard 14 is secured within the opening 28 between the flanges 30 through the utilization of suitable fasteners 34 and the base 16 includes a horizontal planar upper wall 36, a forwardly and downwardly inclined front wall 38, a rearwardly and downwardly inclined rear wall 40 and oppositely downwardly and outwardly inclined opposite side walls 42 and 44. A pair of upstanding mounting flanges 46 and 48 corresponding to the flanges 30 and 32 are secured to the marginal portions of the upper wall 36 defining an opening 50 formed therein corresponding to the opening 28 and the lower end of the pedestal or standard 14 is downwardly telescoped over the flanges 46 and 48 and are secured thereto through the utilization of suitable fasteners 52. Thus, the lower end of the tubular pedestal or standard 14 opens downwardly into the hollow base, the latter being provided with four readily adjustable and removable feet 53 threadedly supported from suitable mounting flange portions 54 carried by the base 16.

A damper or baffle plate 55 is hingedly supported within the base 16 by hinge assembly 56 and includes an oscillatable operating shaft 58 which projects outwardly through an opening 60 formed in the front wall 38 of the base 16. The outer end of the operating shaft 58 includes a lever arm 62 mounted thereon equipped with an outer end handle 64. Accordingly, the lever arm 62, which counterbalances the damper or baffle plate 55, may be angularly displaced to shift the damper or baffle plate 55 between the solid and phantom line positions thereof illustrated in FIG. 6.

If the heater or stove 10 is to be disposed on an imperforate floor or surface, the feet 53 are retained and adjusted to slightly space the lower marginal edges of the base 16 above the floor. In this way, combustion air may enter the hollow base 16 and move upwardly therefrom into the pedestal or standard 14 at a rate determined by the position of the damper or baffle plate 55. However, if the stove or heater 10 is to be used in a mobile home, a combustion air inlet may be cut in a flooring portion of the mobile home over which the base 16 is to be disposed and the feet 53 may be removed so that the lower marginal portions of the base 16 may rest directly upon the mobile home floor and the pedestal or standard 14 may receive combustion air directly through the opening formed in the mobile home floor.

The forward end of the firebox 12 is partially closed by a hollow inverted U-shaped frame referred to in general by the reference numeral 68 including opposite side upstanding portions 70 and 72 and an upper transverse bight portion 73. The interior of the firebox 12 includes a reversely curving lower baffle plate 74 extending and secured between the side walls 24 and 26 and including a rear marginal edge portion 76 which curves downwardly and is secured to the lower marginal portion of the rear wall 22 rearward of the opening 28 as at 78. The forward marginal edge portion of the baffle plate 74 curves upwardly and is secured to the lower free marginal edge of a transverse vertical flange portion 80 extending and secured between the side walls 24 and 26 and the upper marginal edge of the vertical flange portion 80 is secured to the rear marginal edge of a front-to-rear extending transverse lower shelf 82 extending and secured between the side walls 24 and 26, the forward marginal edge of the shalf 82 being secured to the upper forward edge of the bottom wall 20.

The upper bight portion 73 and each of the portions 70, 72 and 74 includes openings 86 formed therein opening toward the remote marginal portions of the forward end of the firebox 12. A solid bar 88 extends across the shelf 82 and interconnects the lower ends of the portions 70 an 72 of the frame 68 and the lower ends of the portions 70 and 72 open downwardly through the shelf 82 into the combustion air heating chamber 90 defined between the lower baffle plate 74 and the bottom wall 20. In addition, the inner surfaces of the opposite side walls 24 and 26 of the firebox 12 include tubular ducts 92 supported therefrom and extending upwardly therealong including upper outlet openings 94 opening toward each other. The lower ends of the ducts 92 open downwardly into the opposite side portions of the combustion air heating chamber 90 at the lower periphery of the firebox 12. Still further, the vertical flange portion 80 includes a plurality of horizontal combustion air inlet openings 96 formed therein and shelf 82 includes a plurality of vertical combustion air inlet openings 98 formed therein.

The frame 68 and the solid bar 88 define a partial front wall for the forward portion of the firebox 12 spaced slightly rearwardly of the rear marginal edges of the top wall 18, the bottom wall 20 and the side walls 24 and 26. Thus, the partial front wall is recessed rearwardly from the forward marginal edges of the firebox 12. Each of the forward marginal edges of the side walls 24 and 26 includes a threaded bore 100 formed therethrough by which a keeper 102 may be supported through the utilization of a suitable threaded fastener 104. Of course, the keeper 102 may be supported from the forward marginal edge of either side wall 24 and 26.

Each of the upstanding portions 70 and 72 includes a pair of vertically spaced front to rear extending threaded bores 106 formed therein and a face plate 108 having corresponding vertically spaced opposite side openings 110 formed therein is secured over the forward surfaces of the frame 68 and the bar 88 through the utilization of suitable fasteners 112 secured through the openings 110 and threaded in the bores 106. In addition, one set of the fasteners 112 mounts a hinge assembly 114 therefrom and a closure door 116 is supported from the hinge assembly 114 is thus hingedly supported from the face plate 108, the door 116 having an opening 120 formed therein and a suitably framed transparent panel 122 being mounted on the door 116 over the opening 120 through the utilization of suitable fasteners 124, see FIG. 2. The face plate 108 has a central opening 126 formed therein in which the transparent panel or window 122 is received and the forward side of the transparent panel or window is covered by a wire mesh 128.

Mounted within the upper rear portion of the firebox 12 is an upper baffle plate 130 which extends between and is supported from the side walls 24 and 26. The upper baffle plate 130 comprises an inverted duplicate of the lower baffle plate 74 and includes a rear lower marginal portion 132 corresponding to the marginal portion 76 which is secured to the rear wall 22 as at 134. The upper forward marginal edge 136 of the baffle plate 130 is spaced below the top wall 18 and a vertical flange 138 extends downwardly from the rear marginal edge of the top wall 18 and is secured to the upper baffle plate 130 a spaced distance from rearward the forward marginal edge thereof. The central portion of the flange 138 is imperforate and the opposite side marginal portions thereof include openings 140 formed therein, see FIG. 3, through which the gaseous by-products of combustion within the firebox 12 must pass before being discharged from the firebox 12.

The center upper marginal portion of the rear wall 22 includes an oval opening 142 formed therein and an oval transversely arcuate smoke outlet fitting 144 is removably secured over the exterior surfaces of the rear wall 22 disposed about the opening 142. The fitting 144 includes an outlet nipple 146 and the fitting 144 may be removed and reversed 180° in position so that the nipple 146 may extend either horizontally rearwardly from the firebox 12 or vertically upwardly therefrom. Of course, the inlet end of the smoke pipe 147 may be telescoped over the nipple 146, as illustrated in phantom lines in FIG. 2 of the drawings.

Figure 8:
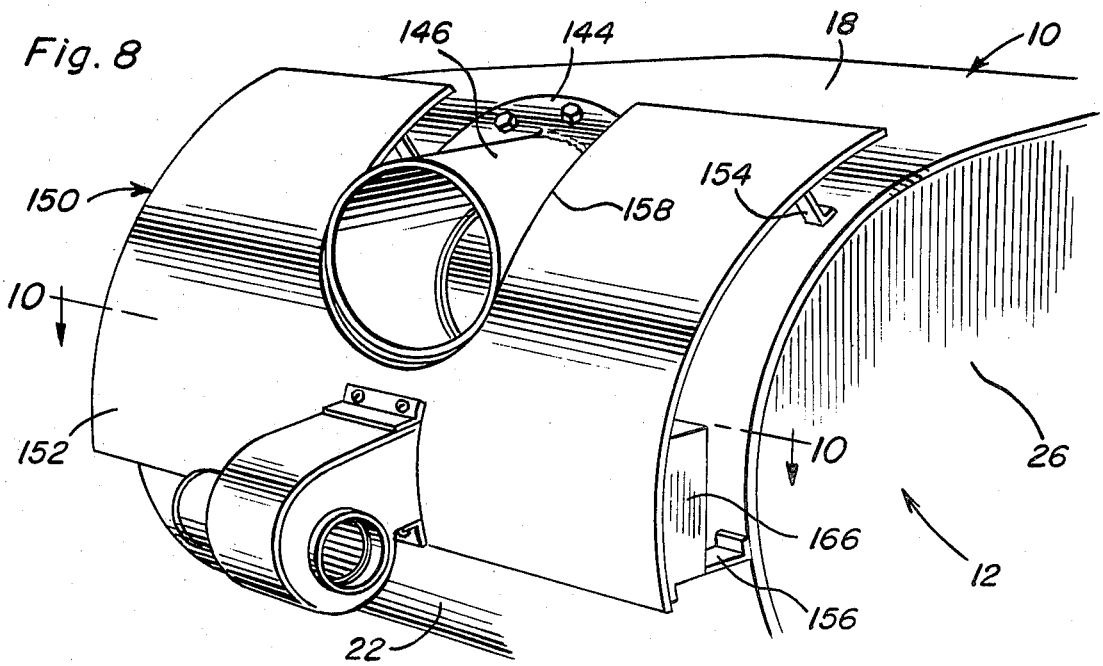
FIG. 8 is a fragmentary rear perspective view of the heater illustrating the blower attachment operatively associated therewith.
Figure 9:
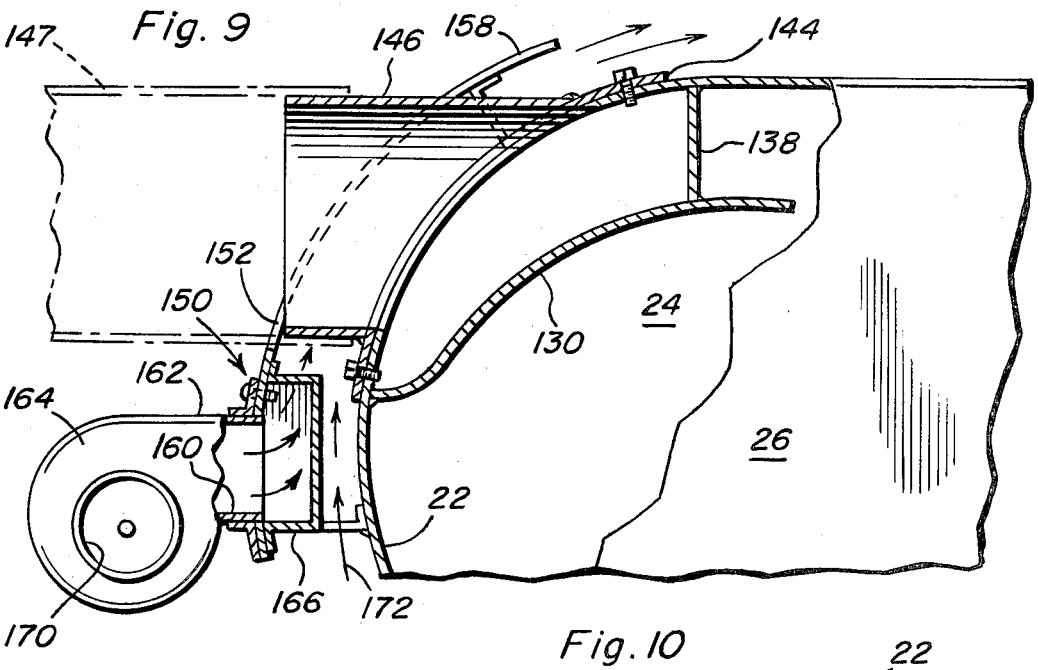
FIG. 9 is a fragmentary side elevational view of the assemblage illustrated in FIG. 8 with portions thereof being broken away and illustrated in vertical section.
Figure 10:
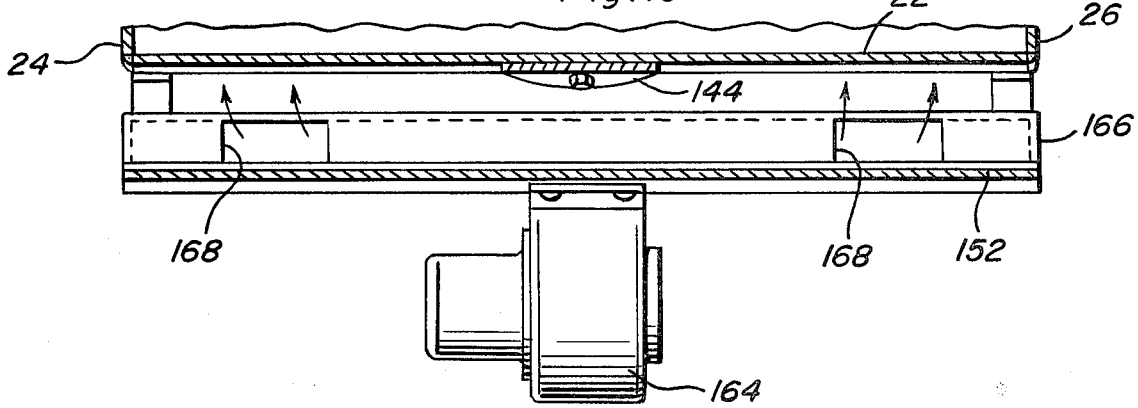
FIG. 10 is an enlarged horizontal sectional view taken substantially upon the plane indicated by the section line 10—10 of FIG. 8.

With attention now invited more specifically to FIGS. 8, 9 and 10 of the drawings, there may be seen a heating air attachment referred to in general by the reference numeral 150. The attachment 150 includes an arcuate plate 152 supported from the rear wall 22 by brackets 154 and 156 and the arcuate plate 152 includes a notch 158 formed therein for receiving the outlet nipple 146 therethrough. The lower central portion of the plate 154 includes an opening 160 formed therein through which the outlet 162 of a blower assembly 164 opens and the inner side of the plate 152 includes a hollow air manifold 166 mounted thereon extending the full width of the plate 152 and closed at its opposite ends. The air manifold 166 includes opposite end openings 168 formed therein and thus the attachment 150 may intake ambient air through the inlet opening 170 of the blower assembly 164 and discharge the ambient air from the blower assembly 164 into the manifold 166 and from the latter through the openings 168 for upward movement between the upper marginal portion of the plate 152 and the opposing outer surfaces of the rear wall 22. In addition, it will be noted that the manifold 166 is spaced rearward of the rear wall 22. Thus, by discharging air upwardly into the area immediately above the manifold 166 between the plate 152 and the rear wall 22, ambient air is also drawn upwardly along the outer surfaces of the lower portion of the rear wall 22 for passage between the manifold 166 and the rear wall 22 as indicated by the arrows 172.

In operation, the door hinge assembly 114 may be mounted on the portions of the face plate 108 overlying either the upstanding portion 70 or the upstanding portion 72 and the keeper 102 may be mounted on the opposite side wall of the firebox. Thus, the door 116 is reversible so that it may open from either the left or right side of the firebox. The front of the door pivotally supports a handle equipped latching lever 174 therefrom which may be engaged with the keeper 102 to retain the door 116 in a closed position. In addition, the inner side of the bight portion 73 of the frame 68 includes a pair of upwardly opening hooks 176 supported therefrom and the opposite ends of the upper marginal portion of an upstanding smoke flange 178 include pivot shaft portions 180 removably journaled from the hooks 176 whereby the flange 108 may swing between the phantom and solid line positions thereof illustrated in FIG. 2 of the drawings.

In operation, the door 116 may be opened to admit solid fuel to be burned into the interior of the firebox 12. The flange 178 may readily swing rearwardly toward the phantom line position thereof to facilitate the entrance of the solid fuel (such as wood logs) into the firebox 12. After the fuel has been ignited within the firebox and the damper or baffle plate 55 has been suitably adjusted, combustion air will enter the combustion air heating chamber 90 and be preheated. A first portion of combustion air will pass rearwardly from the heating chamber 90 through the openings 96 in a horizontal direction toward the fuel being burned and a second portion of combustion air will enter the interior of the firebox 12 from the opposite sides thereof through the openings 94 while a third portion of combustion air will enter the forward portion of the interior of the firebox 12 in an upward direction through the openings 98. The combustion air entering through the openings 96 and the openings 94 support initial combustion of the fuel within the lower portion of the firebox and the air entering the firebox through the openings 98 is mixed with the unburned gaseous combustible material given off by the fire within the firebox to facilitate the burning thereof as the flames and other heat by-products of combustion roll forwardly within the upper portion of the firebox beneath the baffle plate 130 and pass upwardly and rearwardly about the forward marginal edge portion 136 of the baffle plate 130 before passing rearwardly behind the flange 138 through the openings 140 formed therein. Thereafter, the exhaust gases from the combustion of fuel within the firebox 12 must pass toward the center of the upper marginal portion of the rear wall 22 before passing outwardly through the opening 142.

A portion of the heated combustion air also enters the interior of the firebox 12 through the openings 86 formed in the upstanding portions 70 and 72 of the frame 68 and the upper bight portion 73 of the frame 68. This portion of the combustion air sweeps across the interior surface of the transparent panel 122 in order to cool the same and to prevent the collection of soot thereon. In addition, the smoke flange 178 projects downwardly across the extreme upper marginal portion of the opening defined by the frame 68 and thus further prevents forward rolling of smoke within the upper portion of the interior of the firebox 12 from causing smoke and soot to collect on the inner surface of the transparent panel 122.

The attachment 150 causes an upward flow of heating air across not only the upper portion of the rear wall 22 with which the plate 152 is registered, but also the lower portion of the rear wall 22 by the flow of air as indicated by the arrow 172 in FIG. 9. Also, the forwardly and upwardly inclined lower wall 120 creates a natural convection air flow upwardly therealong to further effect a transfer of heat from the bottom wall 20 to the air passing thereover. Of course, the vertical opposite side walls 24 and 26 of the firebox 12 also facilitate an upward movement of convection thereacross in order to effect heat transfer from the side walls 24 and 26 to the convection air flowing thereover. Thus, only the cooking surface upper top wall 18 of the firebox 12 is free of appreciable air flow thereover to effect heat transfer therefrom and the top wall 18 may be used effectively for cooking purposes.

Due to the utilization of the upper baffle plate 130, the flames and other heat by-products of combustion within the firebox 12 rise within the firebox 12 and then roll forwardly within the firebox beneath the baffle plate 130. Thereafter, the flames and other gaseous by-products of combustion roll upwardly and rearwardly about the forward marginal edge portion 136 of the baffle plate 130 and thereafter move toward the opposite side walls 24 and 26 of the firebox and pass behind the flange 138 via the openings 140 formed therein before again passing toward the central portion of the firebox 12 and outwardly of the opening 142.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A heater including a firebox for receiving and burning solid fuel therein, said firebox including a lower wall, a pair of spaced upstanding opposite side walls, a top wall extending between said side walls, a forwardly opening semi-cylindrical rear wall extending between said top and lower walls and between said opposite side walls and combustion air inlet manifold means into which a combustion air inlet means opens, said firebox including a forward portion in which a hollow peripheral frame is mounted, said frame extending peripherally about at least a majority of the inside periphery of the forward portion of said firebox, said combustion air manifold means including a portion thereof opening into the interior of said frame, said frame including air curtain forming air outlet openings formed therein and spaced peripherally thereabout opening inwardly of the corresponding peripheral portion of said frame, a door assembly removably closing the forward portion of said firebox, said door having a heat resistant transparent window therein, said air curtain forming outlets openings being disposed closely rearward of said window and being operative to discharge a curtain of combustion air across the inner surface of said window.

2. The combination of claim 1 wherein said frame is inverted U-shaped in configuration.

3. The combination of claim 1 including a depending transverse smoke flap extending transversely of the upper forward portion of the interior of said firebox immediately rearward of the upper portion of said frame and including upper and lower marginal edge portions disposed above and below, respectively, the lower margin of the upper portion of said frame, said upper marginal edge portion of said smoke flap being hingedly supported relative to said firebox for rearward and upward swinging of the lower marginal edge of said smoke flap.

4. The combination of claim 1 wherein the upper central portion of said rear wall includes a smoke outlet, said smoke outlet including an oval transversely arcuate outlet fitting removably secured over the external surfaces of said semi-cylindrical rear wall about said smoke outlet, said fitting being removably supported from said rear wall for 180° reversal in position of said fitting relative to said rear wall, said fitting including an outwardly projecting outlet nipple supported therefrom, said nipple being horizontally and vertically disposed when said fitting is disposed in alternate 180° reversed positions thereof.

5. A heater including a firebox for receiving and burning solid fuel therein, said firebox including a lower wall, a pair of spaced upstanding opposite side walls, a top wall extending between said side walls, a forwardly opening semi-cylindrical rear wall extending between said top and lower walls and said opposite side walls and combustion air manifold means into which a combustion air inlet opens, said firebox including a forward portion in which a hollow peripheral frame is mounted, said frame extending peripherally about at least a majority of the inside periphery of the forward portion of said firebox, said combustion air manifold means including a portion thereof opening into the interior of said frame, said frame including air curtain forming outlet openings formed therein and spaced peripherablly thereabout opening inwardly of the corresponding peripheral portions of said frame, a door assembly removably closing the forward portion of said firebox, said door assembly being hingedly supported from said firebox for horizontal swinging between open and closed positions thereof and being provided with a transparent window across whose inner surface said air curtains sweep from said outlet openings.

6. The combination of claim 5 wherein said door assembly and firebox include reversibly positionable hinge and hinge mounting means for hingedly supporting said door from either side portion of said firebox.

* * * * *